US005254020A

United States Patent [19]

Obligar

[11] Patent Number: 5,254,020

[45] Date of Patent: Oct. 19, 1993

[54] SNAP ON BATTERY CABLE CONNECTOR

[76] Inventor: Rizal A. Obligar, 602 W. 216th St., Carson, Calif. 90745

[21] Appl. No.: 848,861

[22] Filed: Mar. 10, 1992

[30] Foreign Application Priority Data

Dec. 18, 1991 [PH] Philippines ..... 654677

[51] Int. Cl.[5] ..... H01R 4/30

[52] U.S. Cl. ..... 439/761; 439/755; 439/773

[58] Field of Search ..... 439/761, 769, 770, 772, 439/773, 755

[56] References Cited

U.S. PATENT DOCUMENTS

| | | | |
|---|---|---|---|
| 2,677,812 | 5/1954 | Rieg | 439/761 |
| 3,488,627 | 1/1970 | Martinez | 439/761 |
| 3,739,322 | 6/1973 | Haegart | 439/764 |
| 4,380,291 | 4/1983 | Shannon | 439/755 |
| 4,555,159 | 11/1985 | Chartrain et al. | 439/773 |

FOREIGN PATENT DOCUMENTS

| | | |
|---|---|---|
| 7077 | 10/1990 | Philippines . |
| 7096 | 10/1990 | Philippines . |

*Primary Examiner*—Paula A. Bradley
*Attorney, Agent, or Firm*—Fulwider, Patton, Lee & Utecht

[57] ABSTRACT

A snap on battery connector including a yoke having a pair of jaws projecting flexibly therefrom and coupled on their free extremities with the opposite ends of a linkage, such coupling being by an eccentric cam such that rotation thereof causes the jaws to move between their closed position gripping a battery post and an opened position. A neck projects from the yoke and is formed with a cradle for receiving the battery cable. Such cradle is formed with a pair of spaced apart ribs which cooperate with a laterally extending ridge formed in an overlying clamp to facilitate gripping of the battery cable. In one embodiment, one of the jaws is formed with a stop disposed in the path of a lever arm coupled to such cam to thus prevent over rotation of the lever arm.

1 Claim, 2 Drawing Sheets

SNAP ON BATTERY CABLE CONNECTOR

BACKGROUND OF THE INVENTION

1. Field of the Invention

The present invention relates to a snap on battery connector.

2. Description of the Prior Art

Conventional nut and bolt battery cable connectors suffer the shortcoming that tools, such as wrenches or pliers are required to tighten or loosen the clamp on the battery post. My prior snap on battery cable connectors as disclosed in Philippine Patent Nos. 7077 and 7096 have gained certain popularity in providing a battery post clamp device which is self-contained and is operable without the necessity of tools such as wrenches or pliers. In spite of their general acceptance in the marketplace, such connectors suffer two general shortcomings. While the connectors do provide for secure and long lasting attachment to the cable post, the attachment to the battery cable itself has been less than satisfactory. Thus, there exists a need for a clamp on battery clamp which affords a secure connection with the battery cable.

Secondly, such prior art snap on battery connectors suffer the shortcoming that the cam actuating lever utilized to actuate the connector itself is sometimes over rotated thus causing the operator to lose the orientation and positioning of the lever mechanism in actuating the clamp. Thus, there exists a need for a battery connector in which the orientation of the actuating lever is always maintained.

SUMMARY OF THE INVENTION

The present invention is characterized by a snap on battery connector which incorporates flexible jaws for gripping the opposite sides of a battery post and connected together on their free ends by means of a linkage driven by a lever actuated eccentric cam. A neck is provided at one end of the clamp and includes a groove defining a concave cradle for nesting therein of the battery cable. A cable clamp is provided for overlying the cradle and interlocking ribs and ridges are provided for securing the grip to the cable. In the preferred embodiment, a stop is provided on one of the jaws for limiting rotation of the actuating lever.

Other objects and features of the invention will become apparent from consideration of the following description taken in conjunction with the accompany drawing.

DESCRIPTION OF THE PREFERRED EMBODIMENT

Figure 1:
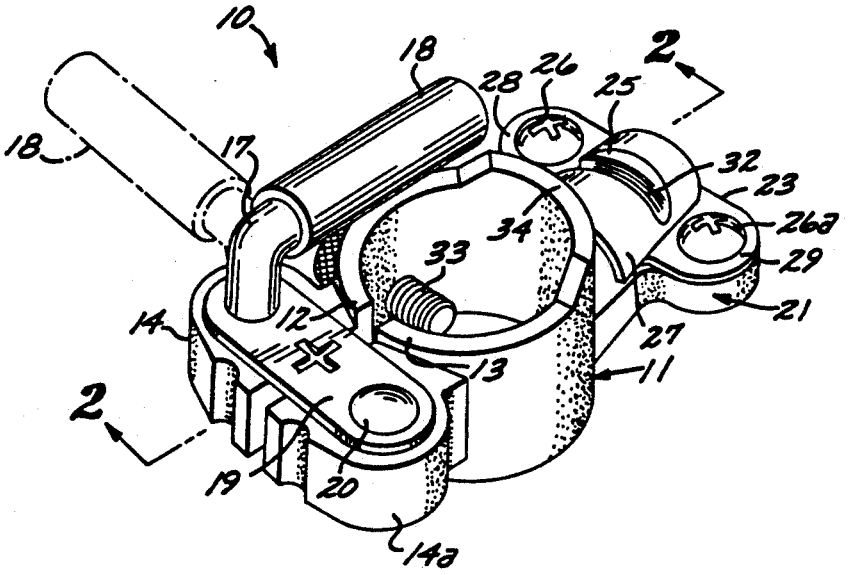
FIG. 1 is a perspective view of the battery cable clamp according to the present invention.
Figure 2:
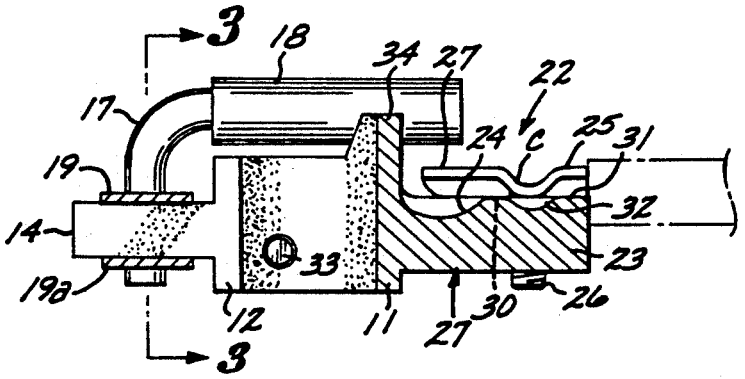
FIG. 2 is a cross-sectional view taken along line 2—2 of FIG. 1.
Figure 3:
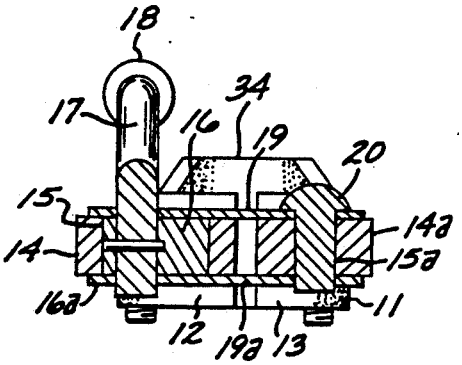
FIG. 3 is a cross-sectional view taken along line 3—3 of FIG. 2

Referring now to the several views of the drawing, the battery cable clamp adapted to be connected to a battery post terminal is shown in FIG. 1 and is generally designated by the reference numeral 10.

The clamp 10 comprises an elongated and electrically conductive body 11 having a circular recess formed therein defining a pair of semi-circular jaws 12 and 13. Formed integrally with jaws 12 and 13 are the ears 14 and **14*a*, respectively. Each ear is provided with circular holes 15 and 15*a*, respectively, and with hole 15** being diametrically larger.

Rotatably positioned within the hole 15 is a circular cam 16. Eccentrically fixed to the cam 16 by means of a lock pin **16*a* is the bent end 17 of the operating lever 18**.

Enclosing the ears 14 and **14*a* are the link arms 19 and 19*a* disposed at top and bottom portions thereof. One of the ends of such link arms 19 and 19*a* are pivotally connected to the bent end 17 of the lever 18 and the other ends are connected to the ears by a suitable rivet or pin 20**.

Integrally formed with the jaws and rearwardly extending therefrom is an extension 21 which is provided fixedly at its free end with a cable gripping means 22. Said cable gripping means is defined by an enlarged portion 23 at the free end of the extension 21 having an elongated groove 24 thereon, and a complementary clamp piece 25 overlying the enlarged portion 23 and detachably and screwably connected thereto by suitable bolts or metal screws 26 and **26*a*. The complementary clamp piece 25 is an elongated actuated metal sheet 27 having opposed ears 28 and 29 that screwably connect to the extension 21. The complementary clamp piece 25, when attached to the extension 21, defines a circular chamber c as the arcuate portion of the piece 25 overlies the elongated groove 24 of said extension 21 forming space 30 to accommodate the connecting cable end. In order that the cable ends will not be detached from the cable gripping means 22, a pair of spacedly disposed transversely ribs 31 are provided on the groove 24 of the gripping means 22. The complementary clamp device 25 is depressed at the rear portion thereof to provide an inward protuberance 32 exactly disposed in between the transverse ribs within the circular chamber c of the gripping means 22**.

Also provided at the central portion of one of the jaws 12 or 13 is a transversely extending adjustable auxiliary screw 33. The auxiliary screw 33 which transverses one of the jaws may be used to fixedly hold the battery terminal post in cases where the terminal post has a much smaller diameter than the diameter of the circular recess formed on said body.

Figure 4:
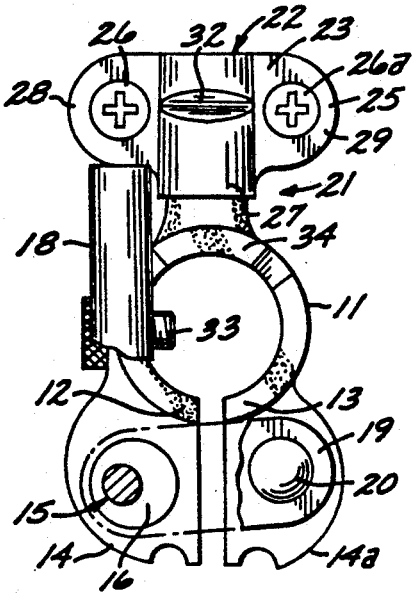
FIG. 4 is a top view of said battery cable clamp with some parts cut away to show inner parts in a closed portion.
Figure 5:
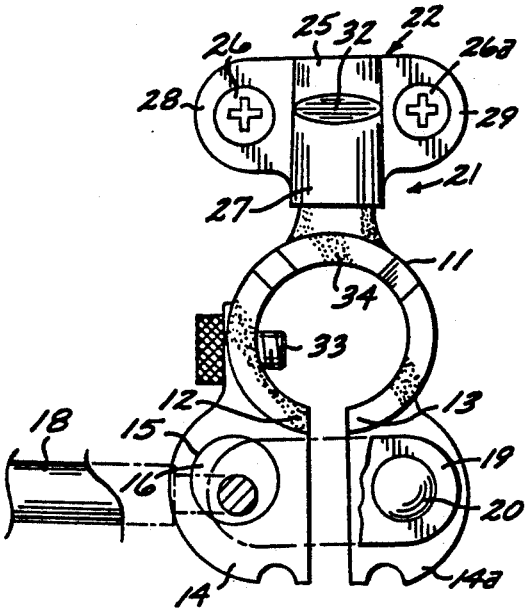
FIG. 5 is a top view thereof with some parts cut away to show inner parts in an open position.
Figure 6:
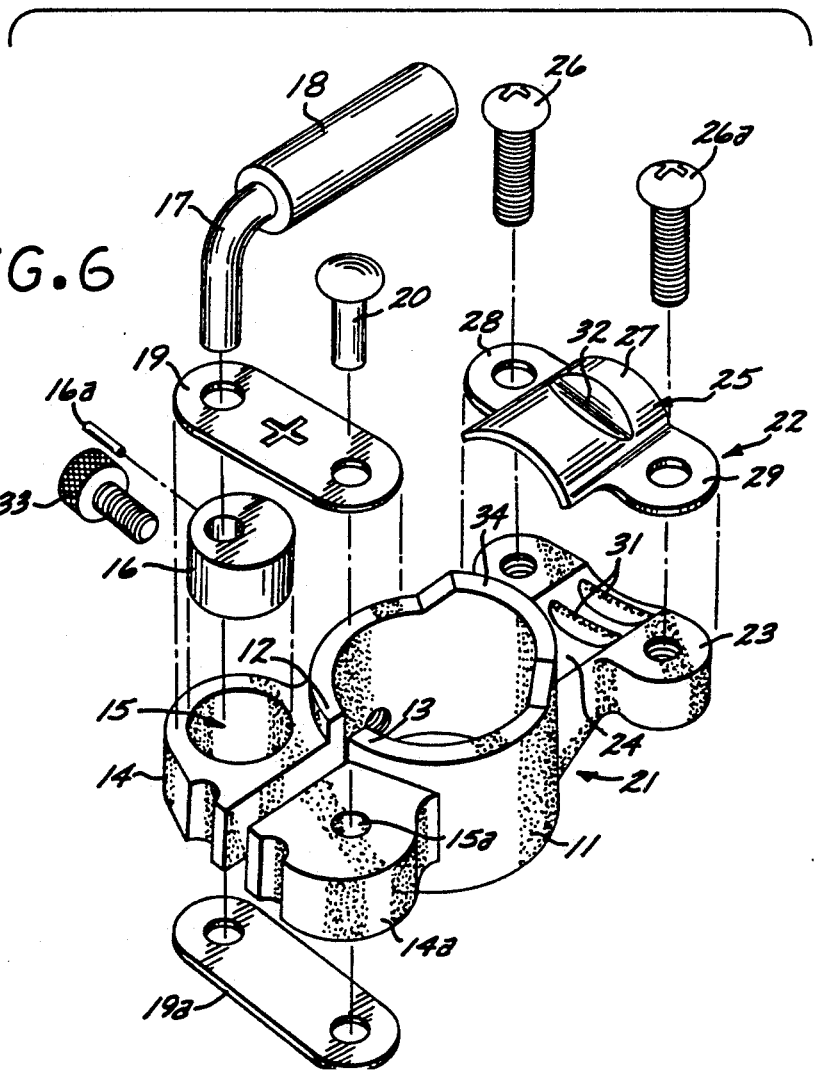
FIG. 6 is an exploded view thereof.

It can be seen in FIGS. 4 and 5 that by turning the operating lever 18 counterclockwise when mounted in a battery terminal post, the cam 16 turns eccentrically and move jaws 12 and 13 closer gripping said battery terminal post. On the other hand, clockwise turn will drive the jaws 12 and 13 away from each other and loosens the grip therefor. Also provided integrally at top rear portion of said jaws is a stopper 34 that limits the movement of the operating lever 18 when turned clockwise.

Various modifications and changes may be made with regard to the foregoing detailed description without departing from the spirit of the invention.

What is claimed is:

1. A snap on battery cable connector for connection to a battery cable and comprising:

an elongated electrically conductive body having a circular recess formed therein defined by a pair of semi-circular jaws projecting from a central yoke, each being formed at the free end thereof with an integral ear, a circular cam rotatably secured on one of said ears, a pair of link arms opposedly disposed at the top and bottom portions of said ears;

a lever eccentrically attached to said cam, which couples the respective one extremities of said links with one said ear; including a handle rotatable through a predetermined path to drive said cam to shift said jaws between a released position and a post grip position;

a rivet connecting the opposite extremities of said links with the other said ear;

an open ended cable gripping neck integrally extending from said yoke and formed with a semi-circular cradle formed with laterally projecting spaced apart ribs for gripping such cable; and a complementary clamp piece overlaying said neck and open on either end is formed with a ridge arranged to cooperate with said ribs in gripping said cable; and screw means for connecting said clamp to said neck; and wherein one of said jaws includes a stop disposed at one end of said path to limit rotation of said handle to prevent the excessive rotation thereof.

* * * * *